US011697963B2

(12) United States Patent
Strait et al.

(10) Patent No.: US 11,697,963 B2
(45) Date of Patent: Jul. 11, 2023

(54) INSULATING PANEL ASSEMBLY

(71) Applicant: Oldcastle BuildingEnvelope Inc., Terrell, TX (US)

(72) Inventors: Billy Strait, McKinney, TX (US); Bob Gebert, Kronenwetter, WI (US); Jeff Geier, Weston, WI (US); Philip M. Benes, Wausau, WI (US); Richard Braunstein, Addison, TX (US); Rick Wright, Delran, NJ (US); Robert Williams, Somerdale, NJ (US); William J. Lang, Rockwall, TX (US)

(73) Assignee: Oldcastle BuildingEnvelope Inc., Terrell, TX (US)

( * ) Notice: Subject to any disclaimer, the term of this patent is extended or adjusted under 35 U.S.C. 154(b) by 179 days.

(21) Appl. No.: 16/863,940

(22) Filed: Apr. 30, 2020

(65) Prior Publication Data

US 2020/0347667 A1 Nov. 5, 2020

Related U.S. Application Data

(60) Provisional application No. 62/841,565, filed on May 1, 2019.

(51) Int. Cl.
*E06B 3/663* (2006.01)
*E06B 3/67* (2006.01)

(52) U.S. Cl.
CPC ..... *E06B 3/6715* (2013.01); *E06B 3/66309* (2013.01); *E06B 2003/6638* (2013.01)

(58) Field of Classification Search
CPC .. E06B 3/663; E06B 3/66304; E06B 3/66309; E06B 3/66314; E06B 3/66319; E06B 3/66323; E06B 3/66328; E06B 3/6715; E06B 2003/6638; E04B 2/92
See application file for complete search history.

(56) References Cited

U.S. PATENT DOCUMENTS 3,852,148 A * 12/1974 Pryor ..... C23D 5/00 428/433
4,000,593 A * 1/1977 Cypher ..... E04B 1/80 52/172
4,113,905 A * 9/1978 Kessler ..... E06B 3/66314 156/109
4,158,278 A * 6/1979 Cardinale ..... E06B 3/66323 52/786.13
4,548,003 A * 10/1985 Johansson ..... E04B 1/003 52/73
4,819,405 A * 4/1989 Jackson ..... E06B 3/677 52/795.1
4,950,344 A * 8/1990 Glover ..... E06B 3/66342 156/104
5,027,574 A * 7/1991 Phillip ..... E06B 3/6612 52/171.3
5,087,489 A * 2/1992 Lingemann ..... E06B 3/6715 428/34

(Continued)

*Primary Examiner* — Kyle J. Walraed-Sullivan
(74) *Attorney, Agent, or Firm* — Henry Patent Law Firm PLLC

(57) ABSTRACT

An insulating panel assembly includes an exterior panel that is formed of a metal. The insulating panel assembly also includes an interior panel. A spacer is coupled to the exterior panel and the interior panel. The spacer maintains the exterior panel in a generally parallel, spaced relationship with the interior panel.

14 Claims, 4 Drawing Sheets

(56) References Cited

U.S. PATENT DOCUMENTS 5,088,258 A * 2/1992 Schield ..... E06B 3/66352 428/34
5,157,893 A * 10/1992 Benson ..... A47J 41/028 52/789.1
5,290,611 A * 3/1994 Taylor ..... E06B 3/66319 428/137
5,302,425 A * 4/1994 Taylor ..... E06B 3/66319 428/137
5,394,671 A * 3/1995 Taylor ..... E06B 3/66314 52/717.02
5,436,040 A * 7/1995 Lafond ..... E06B 3/66328 428/192
5,439,716 A * 8/1995 Larsen ..... E06B 3/66314 428/121
5,460,862 A * 10/1995 Roller ..... E06B 3/66319 428/141
5,675,944 A * 10/1997 Kerr ..... E06B 3/66309 428/34
5,962,090 A * 10/1999 Trautz ..... E06B 3/66319 428/34
5,983,593 A * 11/1999 Carbary ..... E06B 3/6715 52/786.11
6,131,364 A * 10/2000 Peterson ..... E06B 3/66323 52/172
6,612,091 B1 * 9/2003 Glover ..... E06B 3/6604 428/34
6,796,102 B2 * 9/2004 Virnelson ..... C09K 3/10 52/786.13
6,823,644 B1 * 11/2004 Peterson ..... E06B 3/66314 52/172
8,171,684 B2 * 5/2012 Demars ..... E04B 2/72 52/235
9,243,442 B2 1/2016 Weinryb et al.
11,216,305 B2 * 1/2022 Shear ..... H04L 47/70
2004/0202803 A1 * 10/2004 Hoover ..... E06B 3/6715 428/34
2006/0037262 A1 * 2/2006 Siebert ..... E06B 3/66342 52/204.593
2006/0080915 A1 * 4/2006 Vianello ..... E06B 3/6733 52/204.593
2006/0260227 A1 * 11/2006 Winfield ..... E06B 3/677 52/204.593
2008/0295451 A1 * 12/2008 Brunnhofer ..... E06B 3/67321 52/786.13
2009/0077921 A1 * 3/2009 Carbary ..... E06B 3/56 52/656.1
2009/0142521 A1 * 6/2009 Cooper ..... E06B 3/6612 428/34
2011/0296771 A1 * 12/2011 Miller ..... E06B 3/673 52/171.3
2012/0260548 A1 * 10/2012 Andrulewich ..... A47G 1/0605 40/743
2012/0327499 A1 * 12/2012 Parker ..... B32B 37/18 359/275
2013/0074432 A1 * 3/2013 Ciuperca ..... E04B 1/21 52/309.4
2013/0149473 A1 * 6/2013 Frank ..... C03C 17/3644 428/34
2013/0174506 A1 * 7/2013 Bombino ..... E04B 1/7616 52/309.13
2013/0316184 A1 * 11/2013 Siodla ..... E06B 3/66323 428/593
2014/0010976 A1 * 1/2014 Gerardin ..... C03C 17/366 428/34
2014/0208669 A1 * 7/2014 Weinryb ..... E04B 2/96 52/172
2015/0252564 A1 * 9/2015 Ferren ..... E04C 2/324 52/316
2015/0315779 A1 * 11/2015 Baily ..... B32B 3/04 428/69
2016/0060948 A1 * 3/2016 Burrows ..... E06B 3/6612 428/34
2016/0096344 A1 * 4/2016 Kurihara ..... B32B 17/10137 428/34
2016/0290032 A1 * 10/2016 Kuster ..... E06B 3/6733
2017/0028686 A1 * 2/2017 Wilson ..... B32B 7/05
2017/0152701 A1 * 6/2017 Kuster ..... E06B 3/67304
2017/0167188 A1 * 6/2017 Burrows ..... E06B 9/24
2017/0321473 A1 * 11/2017 Frank ..... C03C 27/10
2018/0038151 A1 * 2/2018 Clarahan ..... E06B 7/14
2018/0038154 A1 * 2/2018 Vianello ..... B29C 31/042
2018/0058139 A1 * 3/2018 Schwerdt ..... E06B 3/66319
2018/0223590 A1 * 8/2018 Burrows ..... E06B 3/66366
2018/0224689 A1 * 8/2018 DeMiglio ..... C03C 17/23
2018/0298673 A1 * 10/2018 Runze ..... E06B 3/66319
2018/0344053 A1 * 12/2018 Schreiber ..... E06B 3/66361
2019/0048651 A1 * 2/2019 Baquet ..... A47F 3/001
2019/0090660 A1 * 3/2019 Baquet ..... A47F 3/0434
2019/0112866 A1 * 4/2019 Baquet ..... E06B 3/66333
2019/0211613 A1 * 7/2019 Culot ..... E06B 3/66333
2019/0284868 A1 * 9/2019 Schweitzer ..... C03C 17/3681
2020/0148587 A1 * 5/2020 Burrows ..... C03C 17/3417
2020/0300029 A1 * 9/2020 Hervieux ..... E06B 3/66366
2021/0047879 A1 * 2/2021 Neander ..... E06B 3/6722
2021/0246714 A1 * 8/2021 Neander ..... E06B 3/66319

* cited by examiner

INSULATING PANEL ASSEMBLY

CROSS-REFERENCE TO RELATED APPLICATIONS

The present application claims priority to, and incorporates by reference the entire disclosure of, U.S. Provisional Patent Application No. 62/841,565, filed on May 1, 2019.

TECHNICAL FIELD

The present disclosure relates generally to architectural panels and more specifically, but not by way of limitation, to insulating panel assemblies having an exterior metal sheet.

BACKGROUND

An insulated metal panel ("IMP") is a common exterior feature of many structures. IMPs allow certain exterior building features to be substantially concealed while, at the same time, serve as a barrier to heat transfer through the IMP. IMPs are typically manufactured by laminating one or more metal sheets onto a generally-planar insulator. This production method requires that the edges of the IMP be treated following lamination to reduce the risk that the metal sheets delaminate from the insulator or to make the edge regions of the IMP aesthetically acceptable.

SUMMARY

Aspects of the disclosure relate to an insulating panel assembly. The insulating panel assembly includes an exterior panel. The exterior panel is formed of a metal. An interior panel has a length equal to the exterior panel. A spacer is coupled to the exterior panel and the interior panel. The spacer maintains the exterior panel in a generally parallel, spaced relationship with the interior panel such that a gap is defined between the exterior panel and the interior panel.

Aspects of the disclosure relate to a method of manufacturing an insulating panel assembly. The method includes forming an exterior panel from a metal. An interior panel having a length equal to the exterior panel is formed. The exterior panel and the interior panel are coupled to a spacer such that a gap is defined between the exterior panel and the interior panel. The exterior panel and the interior panel are maintained in a generally parallel, spaced relationship.

BRIEF DESCRIPTION OF THE DRAWINGS

For a more complete understanding of the present disclosure and for further objects and advantages thereof, reference may now be had to the following description taken in conjunction with the accompanying drawings in which.

DETAILED DESCRIPTION

Various embodiments will now be described more fully with reference to the accompanying drawings. The disclosure may, however, be embodied in many different forms and should not be construed as limited to the embodiments set forth herein.

Currently, IMPs typically include at least one exterior panel that is laminated to an insulating material. In applications where the edges of such panels are exposed, the bond between the exterior panel and the insulating material can wear and become delaminated from the insulating material. Additionally, lamination often requires that the edges of the IMP be treated following lamination to reduce the risk that the metal sheets delaminate from the insulator or to make the edge regions of the IMP aesthetically acceptable. Further, IMPs often experience stresses caused by differing coefficients of thermal expansion between laminated layers of the IMP.

Figure 2:
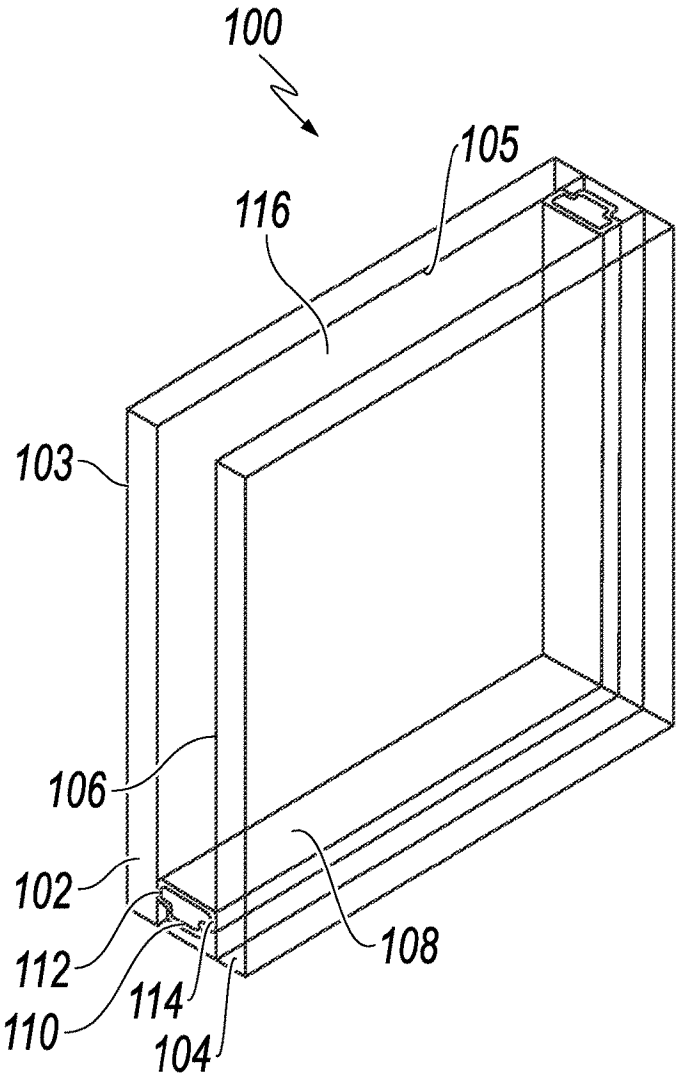
FIG. 2 is an interior perspective view of the insulating panel assembly of FIG. 1 in accordance with aspects of the disclosure.
Figure 1:
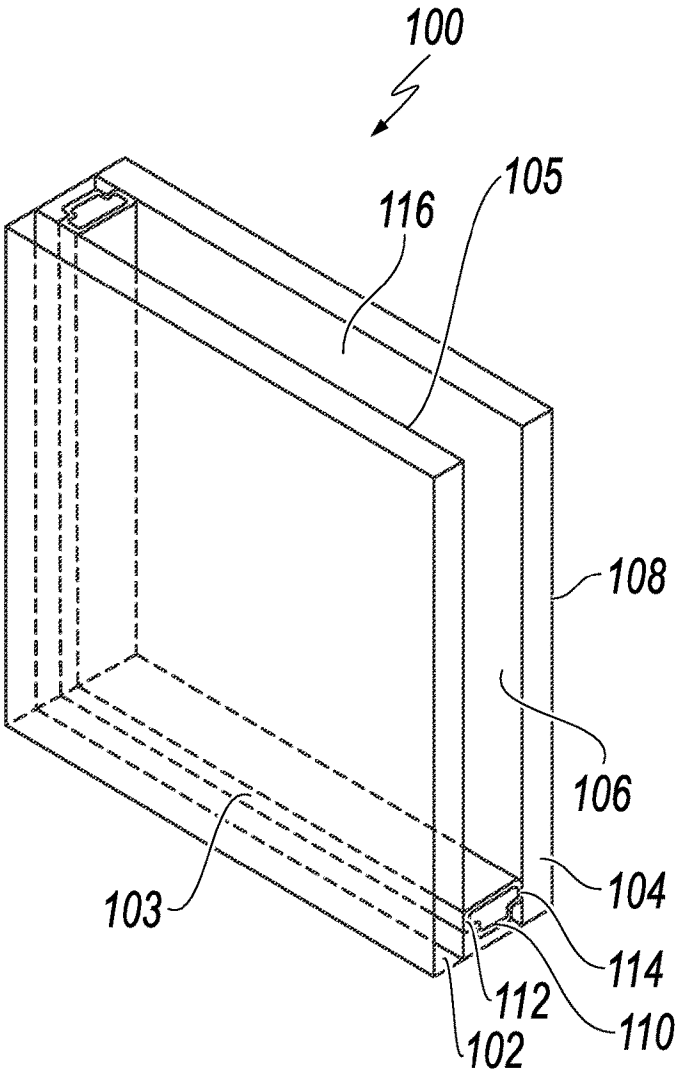
FIG. 1 is an exterior perspective view of an insulating panel assembly in accordance with aspects of the disclosure.

FIG. 1 is an exterior perspective view of an insulating panel assembly 100. FIG. 2 is an interior perspective view of the insulating panel assembly 100. Referring to FIGS. 1-2 collectively, the insulating panel assembly 100 includes an exterior panel 102 arranged on a building-exterior-facing side of the insulating panel assembly 100. The exterior panel 102 is arranged in a generally parallel, spaced relationship with an interior panel 104. The interior panel 104 is arranged on a building-interior-facing side of the insulating panel assembly 100. In various embodiments, the exterior panel 102 is a finished metal panel constructed of, for example, steel, aluminum, various alloys, painted steel, anodized stainless steel, or porcelain-enamel-coated steel. By way of example, the exterior panel 102 is illustrated herein as having a smooth exterior-facing surface 103 (commonly referred to as the "number 1 surface"). However, in other embodiments the exterior-facing surface 103 of the exterior panel 102 could include, for example, patterns or textures in an effort to achieve a desired building aesthetic appearance. In various embodiments, the interior panel 104 is, for example, a monolithic architectural glass panel; however, in other embodiments, the interior panel 104 could be constructed of, for example, laminated glass, patterned decorative glass, stone, or other impervious material. In other embodiments, the interior panel 104 could be constructed of, for example, a finished metal panel of the type described above with respect to the exterior panel 102. The interior panel 104 may, in various embodiments, include a low emissivity coating on either a first surface 106 of the interior panel 104 (commonly referred to as the "number 3 surface") or a second surface 105 of the exterior panel 102 (commonly referred to as the "number 2 surface"). In various embodiments, however, the low emissivity coating may be applied to a second surface 108 of the interior panel 104 (commonly referred to as the "number 4 surface").

Still referring to FIGS. 1-2, the exterior panel 102 and the interior panel 104 are maintained in a spaced relationship by a spacer 110. In various embodiments, the spacer 110 is constructed of a material such as, for example, aluminum, stainless steel, galvanized steel, or any other appropriate material. In other embodiments, the spacer 110 may be constructed of a material with a low thermal conductivity such as, for example, composite materials such as fiber-reinforced polymers, structural foam, plastic-hybrid stainless steel, or a thermally-broken aluminum assembly having a thermal plastic spacer. The spacer 110 includes a first attachment surface 112 and a second attachment surface 114 that is arranged generally parallel to the first attachment surface 112. In various embodiments, the first attachment surface 112 of the spacer 110 may be coupled to the exterior panel 102 and second attachment surface 114 of the spacer 110 may be coupled to the interior panel 104 via an adhesive applied to at least one of the exterior panel 102, the interior panel 104, and the spacer 110. In various embodiments, the adhesive may include multiple layers of, for example, polyisobutylene (PIB) and silicone. In other embodiments, the spacer 110 may be mechanically joined to the exterior panel 102 and the interior panel 104 by fasteners such as, for example, screws, bolts, rivets, or other similar fasteners. The spacer 110 creates a gap 116 between the exterior panel 102 and the interior panel 104. In various embodiments, the gap 116 may be of varying dimensions. For example, in various embodiments, the gap 116 could be wider than or narrower than a thickness of at least one of the exterior panel 102 and the interior panel 104. During use, the insulating panel assembly 100 is arranged in a structure such as, for example, a commercial building, such that the exterior panel 102 faces an exterior of the building and the interior panel 104 faces an interior of the building. In various embodiments, the gap 116 may be filled with, for example, air. In other embodiments, the gap 116 may be filled with a gas such as, for example, argon or krypton. The gap 116 functions as a barrier to conductive heat transfer through the insulating panel assembly 100. In various embodiments, a width of the gap 116 may be adjusted in an effort to optimize insulating properties of the insulating panel assembly 100. In embodiments where a low-emissivity coating is applied to the interior panel 104, heat transfer across the insulating panel assembly 100 is improved. In such embodiments, the low emissivity coating is applied either to a first surface 106 of the interior panel 104 (commonly referred to as the "number 3 surface") or a second surface 105 of the exterior panel 102 (commonly referred to as the "number 2 surface"). In various embodiments, however, the low emissivity coating may be applied to a second surface 108 of the interior panel 104 (commonly referred to as the "number 4 surface").

Figure 4:
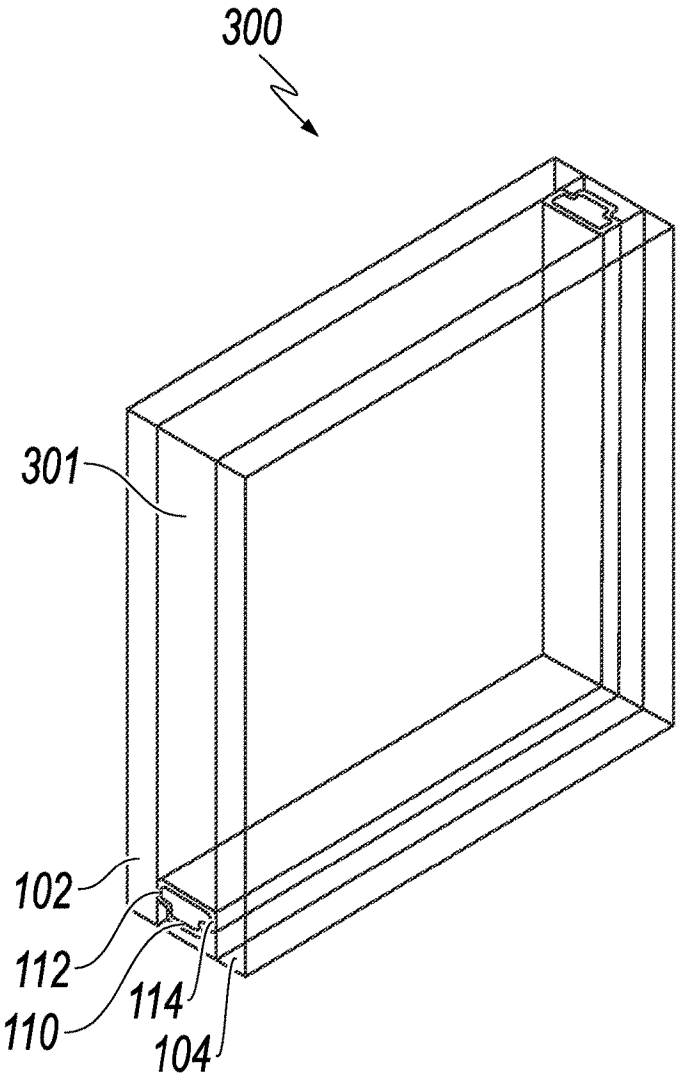
FIG. 4 is an interior perspective view of the insulating panel assembly of FIG. 3 in accordance with aspects of the disclosure.
Figure 3:
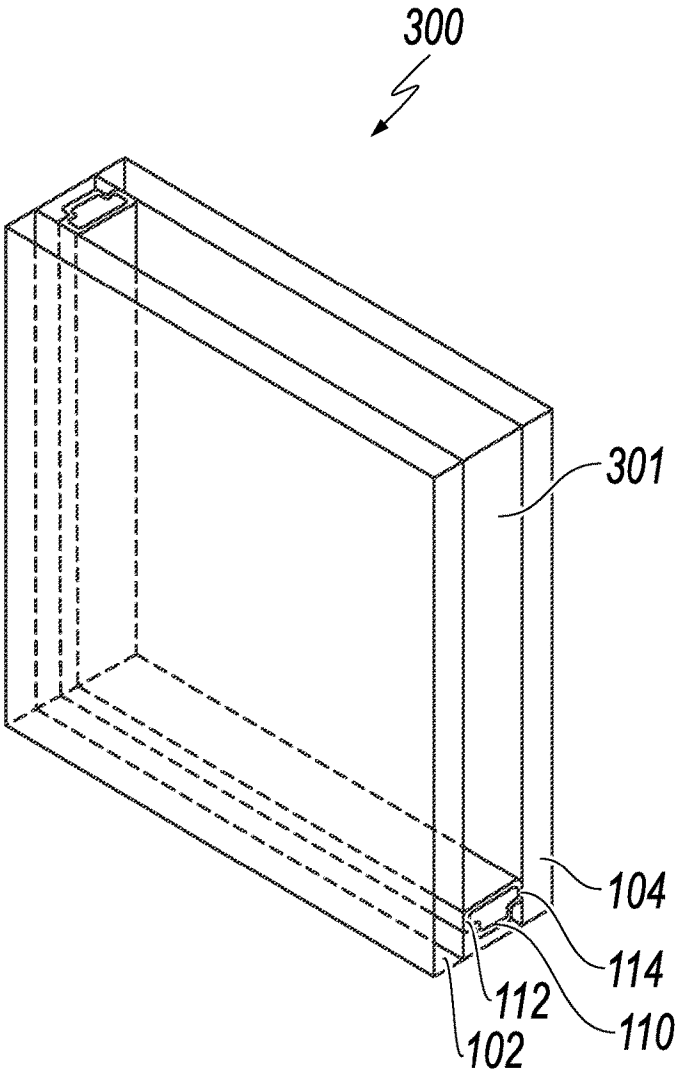
FIG. 3 is an exterior perspective view of an insulating panel assembly with insulation in accordance with aspects of the disclosure.

FIG. 3 is an exterior perspective view of an insulating panel assembly 300 with insulation 301. FIG. 4 is an interior perspective view of the insulating panel assembly 300. Referring to FIGS. 3-4 collectively, the insulating panel assembly 300 includes the exterior panel 102 and the interior panel 104. Insulation 301 is positioned between the exterior panel 102 and the interior panel 104. In various embodiments, the insulation 301 is solid insulation that is coupled to at least one of the exterior panel 102, the interior panel 104, and the spacer 110 via an adhesive applied to at least one of the exterior panel 102 and the interior panel 104. In such embodiments, the insulation 301 may be, for example, foam or any other type of solid insulation. In other embodiments, the insulation 301 could be free floating between the exterior panel 102 and the interior panel 104. In various other embodiments, the insulation 301 could be, for example, a liquid or a gel. During use, the insulating panel assembly 300 is arranged in a structure such as, for example, a commercial building, such that the exterior panel 102 faces an exterior of the building and the interior panel 104 faces an interior of the building. The insulation 301 functions as a barrier to conductive and convective heat transfer through the insulating panel assembly 300. Additionally, in embodiments, where the exterior panel 102 is constructed of a metal, heat transfer via radiation could be reduced by reflection of the radiation from the exterior panel 102; however, the amount of reflection varies with a finish applied to the exterior panel 102.

Figure 5:
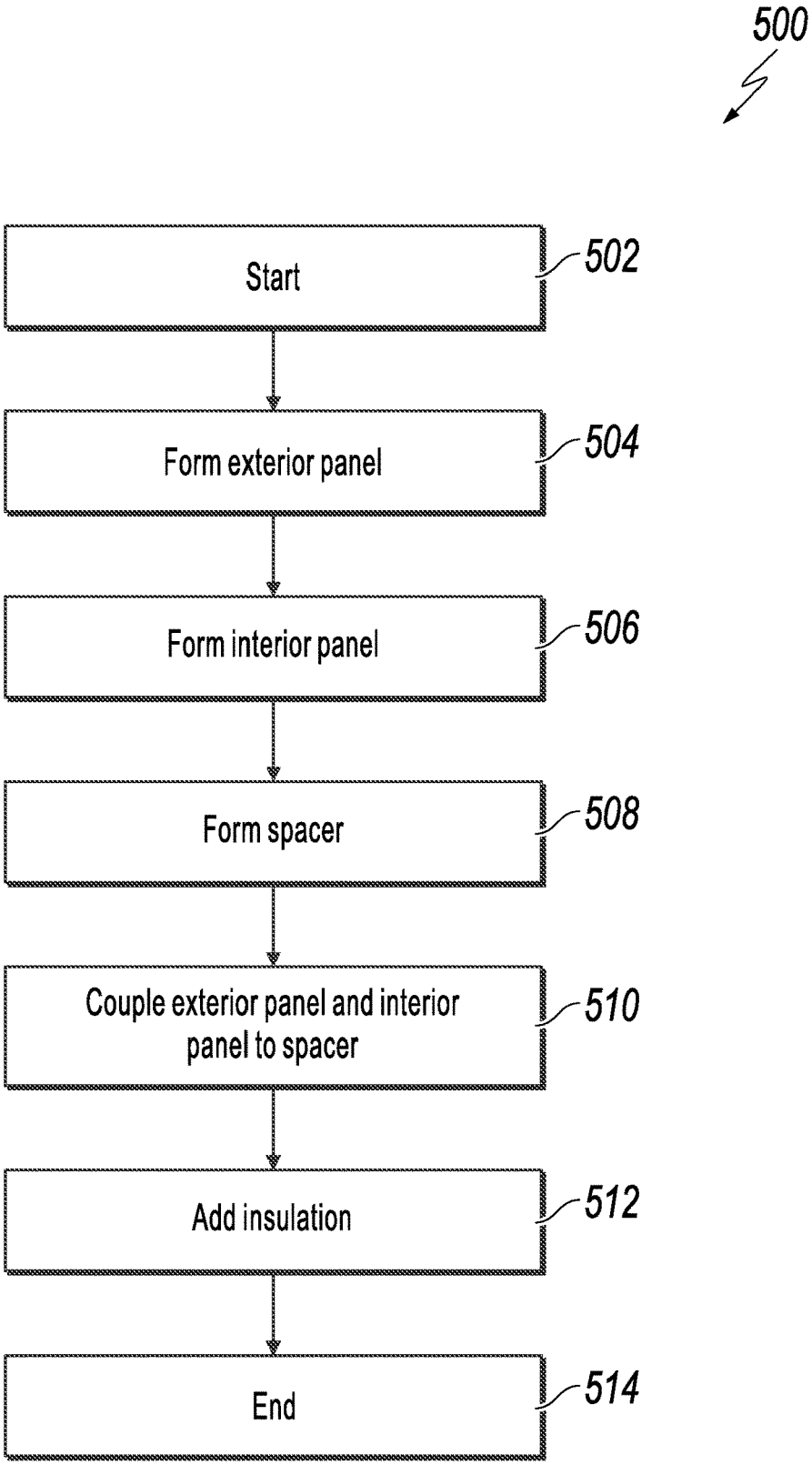
FIG. 5 is a flow diagram illustrating a process for manufacturing an insulating panel assembly according to aspects of the disclosure.

FIG. 5 is a flow diagram illustrating a process 500 for manufacturing an insulating panel assembly. The process 500 begins at step 502. At step 504, the exterior panel 102 and the interior panel 104 are coupled to the first attachment surface 112 and the second attachment surface 114 of the spacer 110, respectively. In various embodiments, the exterior panel 102 may be coupled to the first attachment surface 112 via an adhesive or with the use of mechanical fasteners such as, for example, screws, bolts, rivets, or other similar fasteners. Similarly, the interior panel 104 may be coupled to the second attachment surface 114 via an adhesive or with the use of mechanical fasteners such as, for example, screws, bolts, rivets, or other similar fasteners. At step 506, the insulation 301 is added between the exterior panel 102 and the interior panel 104. In various embodiments, the insulation could include injecting chemical components into the gap 116 between the exterior panel 102 and the interior panel 104 such that the chemical components react on contact to form an insulating foam. In other embodiments, step 506 may include injecting a gas such as, for example, Argon or Krypton, into the gap 116. In still other embodiments, step 506 may be omitted. In still other embodiments, insulation may be added in step 506 before the exterior panel 102 and the interior panel 104 are coupled to the spacer 110 in step 502. In such embodiments, the insulation could be coupled to at least one of the exterior panel 102, the interior panel 104, and the spacer 110 via, for example, an adhesive. The process 500 ends at step 508.

Figure 6:
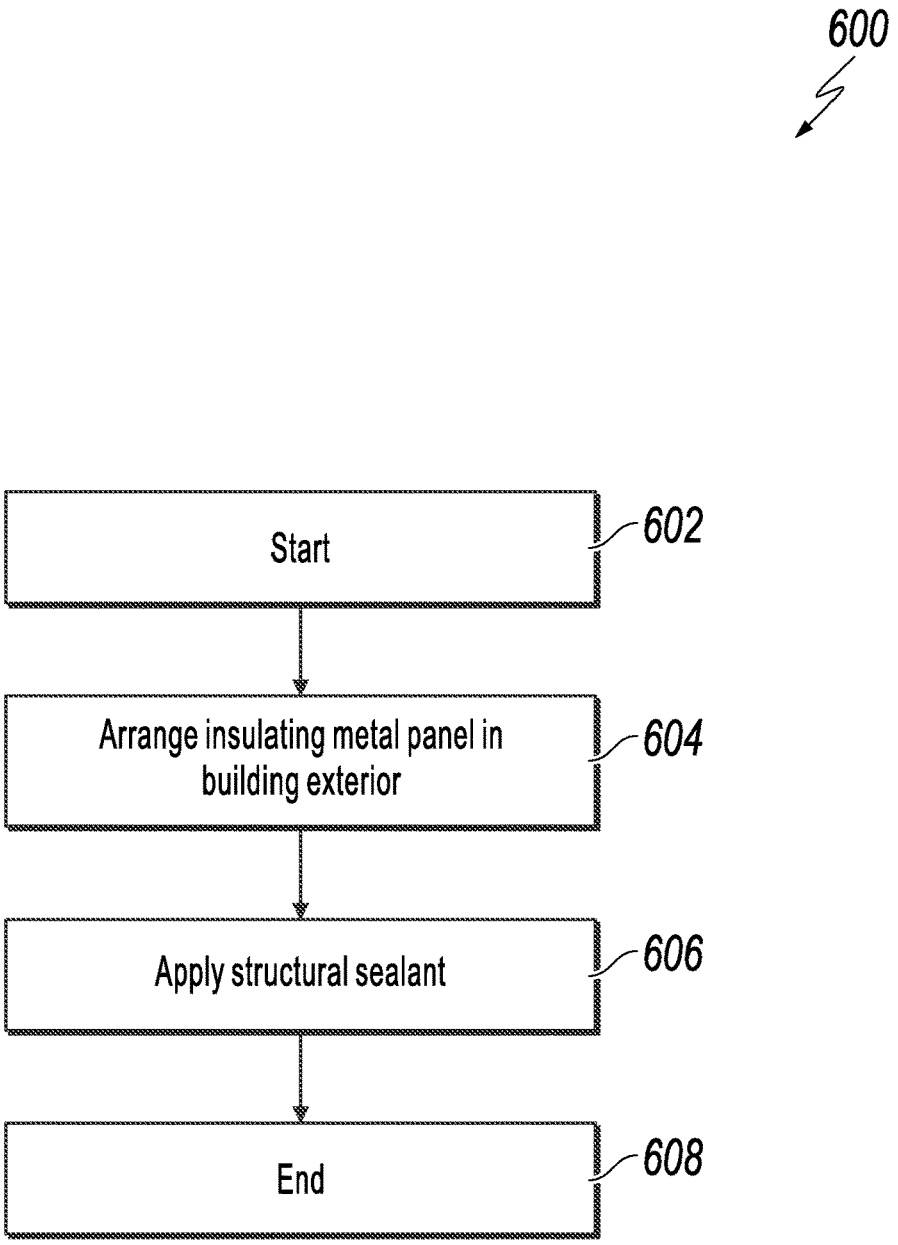
FIG. 6 is a flow diagram of a process for installing an insulated metal panel according to aspects of the disclosure.

FIG. 6 is a flow diagram of a process 600 for installing an insulated metal panel. The process 600 begins at step 602. At step 604, the insulated metal panel is arranged in a building exterior. In various embodiments, the insulated metal panel could be, for example, the insulating panel assembly 100 or the insulating panel assembly 300 discussed above. The insulated metal panel is arranged such that the exterior panel 102 faces an exterior of the building and the interior panel 104 faces an interior of the building. At step 606, a structural sealant is applied to the interior panel 104. In various embodiments, the structural sealant may be, for example, structural silicone or other appropriate sealant. The process 600 ends at step 608.

In various embodiments, because the insulating panel assembly 100 and the insulating panel assembly 300 include the exterior panel 102 and the interior panel 104 that are secured to the spacer 110, and are not laminated to a centrally-located insulator, the insulating panel assembly 100 is not at risk of delamination of the exterior panel 102 or the interior panel 104. Further, the insulating panel assembly 100 and the insulating panel assembly 300 do not require any additional edge treatment to be aesthetically acceptable or to prevent delamination. Omission of edge treatment represents a reduction of production time and costs. Additionally, use of glass facilitates the insulating panel assembly 100 and the insulating panel assembly 300 being resistant to buckling.

Additionally, IMPs often include a foam core within a metal envelope. In contrast, the exterior panel 102 may, in various embodiments, be a solid metal sheet and, as such, provide improved support in structural applications over a foam envelope. Further, by manufacturing the exterior panel 102 of metal, and thereby orienting such a metal panel towards an exterior of a building, the insulating panel assembly 100 and the insulating panel assembly 300 exhibit improved utility in structural silicone glazing ("SSG") applications because the silicone will be adhered to the interior panel 104, which is commonly made of glass. In such applications using currently-available IMPs, the structural silicone is applied to a metal panel which causes critical adhesion strength to vary based up on the metal finish. Finally, the exterior panel 102, commonly manufactured of metal, extends the full width and height of the insulating panel assembly 100 and the insulating panel assembly 300. Such an arrangement allows the insulating panel assembly 100 and the insulating panel assembly 300 to be assembled using traditional insulated glass assembly processes and equipment.

Although various embodiments of the method and system of the present disclosure have been illustrated in the accompanying Drawings and described in the foregoing Specification, it will be understood that the disclosure is not limited to the embodiments disclosed, but is capable of numerous rearrangements, modifications, and substitutions without departing from the spirit and scope of the disclosure as set forth herein. It is intended that the Specification and examples be considered as illustrative only.

What is claimed is:

1. An insulating panel assembly comprising:

a building exterior facing panel, the building exterior facing panel being formed of a metal;

a building interior facing panel, the building interior facing panel having a length equal to the building exterior facing panel; and a spacer formed of a material that is aluminum, stainless steel, galvanized steel, fiber-reinforced polymers, structural foam, plastic-hybrid stainless steel, or a thermally-broken aluminum assembly having a thermal plastic spacer, the spacer being connected to the metal building exterior facing panel and the building interior facing panel, the spacer maintaining the metal building exterior facing panel in a generally parallel, spaced relationship with the building interior facing panel such that an unfilled gap is defined between the metal building exterior facing panel and the building interior facing panel.

2. The insulating panel assembly of claim 1, comprising a gas disposed in the gap.

3. The insulating panel assembly of claim 2, wherein the gas is at least one of air, Argon, and Krypton.

4. The insulating panel assembly of claim 1, wherein the building interior facing panel is formed from an architectural glass.

5. The insulating panel assembly of claim 4, wherein the architectural glass is at least one of laminated glass and patterned decorative glass.

6. The insulating panel assembly of claim 1, comprising a coating applied to at least one of the building interior facing panel and the building exterior facing panel.

7. The insulating panel assembly of claim 1, wherein reflectance of the building exterior facing panel facilitates thermal insulation of the insulating panel assembly.

8. The insulating panel assembly of claim 1, wherein the building interior facing panel imparts rigidity to the insulating panel assembly.

9. A method of manufacturing an insulating panel assembly, the method comprising:

forming a building exterior facing panel from a metal;

forming a building interior facing panel, the building interior facing panel having a length equal to the building exterior facing panel; and coupling the building exterior facing panel and the building interior facing panel to a spacer such that an unfilled gap is defined between the building exterior facing panel and the building interior facing panel and the building exterior facing panel and the building interior facing panel are maintained in a generally parallel, spaced relationship, the spacer being a spacer formed of a material that is aluminum, stainless steel, galvanized steel, fiber-reinforced polymers, structural foam, plastic-hybrid stainless steel, or a thermally-broken aluminum assembly having a thermal plastic spacer.

10. The method of claim 9, wherein the building interior facing panel and the building exterior facing panel do not require edge treatment.

11. The method of claim 9, wherein, when installed, structural silicone is applied to the building interior facing panel.

12. The method of claim 9, wherein a gas is disposed in the gap.

13. The method of claim 9, comprising applying a coating to at least one of the building exterior facing panel and the building interior facing panel.

14. The method of claim 9, wherein the building interior facing panel is formed from an architectural glass.

* * * * *